US009847609B2

(12) United States Patent
Planard-Luong

(10) Patent No.: US 9,847,609 B2
(45) Date of Patent: Dec. 19, 2017

(54) ELECTRICAL ASSEMBLY WITH LEAKTIGHT CONNECTION

(71) Applicant: L'OREAL, Paris (FR)

(72) Inventor: Thi Hong Lien Planard-Luong, Bures sur Yvettes (FR)

(73) Assignee: L'OREAL, Paris (FR)

( * ) Notice: Subject to any disclaimer, the term of this patent is extended or adjusted under 35 U.S.C. 154(b) by 10 days.

(21) Appl. No.: 14/915,465

(22) PCT Filed: Aug. 27, 2014

(86) PCT No.: PCT/IB2014/064095
§ 371 (c)(1),
(2) Date: Feb. 29, 2016

(87) PCT Pub. No.: WO2015/028953
PCT Pub. Date: Mar. 5, 2015

(65) Prior Publication Data

US 2016/0211627 A1 Jul. 21, 2016

(30) Foreign Application Priority Data

Aug. 28, 2013 (FR) ..... 13 58233

(51) Int. Cl.
*H01R 33/96* (2006.01)
*H01R 13/703* (2006.01)
(Continued)

(52) U.S. Cl.
CPC ..... *H01R 13/7036* (2013.01); *H01R 13/521* (2013.01); *H01R 13/5219* (2013.01);
(Continued)

(58) Field of Classification Search
CPC ..... H01H 35/34; H01H 35/346; H01R 13/71; H01R 13/70; H01R 13/701; H01R 33/955
(Continued)

(56) References Cited

U.S. PATENT DOCUMENTS 4,146,286 A 3/1979 Jones
4,891,013 A 1/1990 Komaki
(Continued)

FOREIGN PATENT DOCUMENTS

DE 2618347 A1 11/1977
DE 3305185 A1 8/1984
(Continued)

OTHER PUBLICATIONS

Jan. 22, 2015 International Search Report issued in International Patent Application No. PCT/IB2014/064095.
(Continued)

*Primary Examiner* — Vanessa Girardi
(74) *Attorney, Agent, or Firm* — Oliff PLC

(57) ABSTRACT

Electrical assembly, comprising: —a base part (20), and —a removable part (10) configured to be fixed in a removable manner on the base part (20), the base part (20) comprising: —a flexible membrane (22) delimiting, at least in part, a leaktight internal volume (24), —at least one movable electrically conducting element (25), carried by the membrane (22), and extending, at least in part, in the internal volume (24), and —at least one internal electrical contact (28) disposed in the internal volume (24) under the movable conducting element (25), the movable conducting element (25) contacting, during a deformation of the membrane related to the assembly of the removable part (10) on the base part (20), the internal electrical contact (28) for the establishment of an electrical connection between them, and being distant from the internal electrical contact in the absence of fixing of the removable part on the base part.

20 Claims, 5 Drawing Sheets

Figure 1:
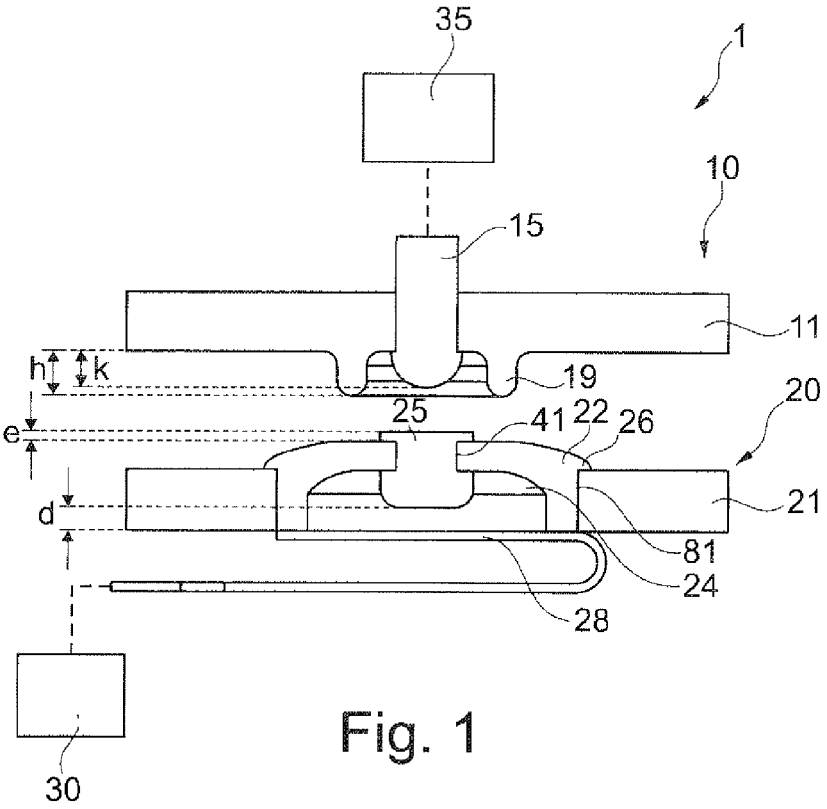

(51) Int. Cl.
*H01R 13/52* (2006.01)
*H01R 13/71* (2006.01)
*H01R 13/24* (2006.01)

(52) U.S. Cl.
CPC ..... *H01R 13/703* (2013.01); *H01R 13/71* (2013.01); *H01R 13/24* (2013.01)

(58) Field of Classification Search
USPC ..... 200/51 R, 211, 512, 509, 51.09, 51.07, 200/51.11–51.14; 439/230, 231
See application file for complete search history.

(56) References Cited

U.S. PATENT DOCUMENTS

| | | | |
|---|---|---|---|
| 5,378,165 | A | 1/1995 | Comerci et al. |
| 5,562,467 | A | 10/1996 | Davis, II et al. |
| 5,743,757 | A | 4/1998 | Chen |
| 5,822,808 | A | 10/1998 | Esser |
| 2002/0018343 | A1 | 2/2002 | Steger |

FOREIGN PATENT DOCUMENTS

| | | | |
|---|---|---|---|
| DE | 4319034 | C1 | 2/1995 |
| EP | 0412444 | A1 | 2/1991 |
| EP | 2323226 | A1 | 5/2011 |
| JP | H08-145678 | A | 6/1996 |

OTHER PUBLICATIONS

Mar. 1, 2016 International Preliminary Report on Patentability issued in International Patent Application No. PCT/IB2014/064095.

ELECTRICAL ASSEMBLY WITH LEAKTIGHT CONNECTION

The present invention relates to an electrical assembly comprising a removable part and a base part intended to be fixed together in a separable manner.

The establishment of a leaktight electrical connection, meeting standard IP67 in particular, is usually effected by connecting a male part to a female part, leaktightness being ensured by the presence of one or more gasket seals. In the absence of connection, the leaktight fixing of a stopper on the idle part is necessary.

Another known solution consists in circumventing the necessity for the stopper through the presence of a manually actuatable switch, to turn off the idle part. The establishment of the electrical connection is done in these two solutions in two steps, and poor manipulation may give rise to discomfort, or indeed a risk for the operator.

Devices comprising an apparatus and a battery support cooperating with the apparatus by leaktight connection of complementary contacts are known from the publications U.S. Pat. No. 5,822,808 and JP 8 145 678.

A leaktight battery support intended to cooperate with an apparatus with electrical connection via leaktight contacts is known from application US 2002/0018343, the battery support comprising a switch cutting the electrical power supply when the support is not assembled with the apparatus, actuatable by a magnetic force.

A need exists to simplify the establishment of a leaktight and reliable electrical connection by assembly of two removable parts, while limiting the operator risks related to possible poor manipulation, as well as the risks of corrosion of the contact surfaces in case of exposure to a damp or liquid environment with these surfaces under live voltage.

SUMMARY

The invention is aimed at meeting this need and its subject is, according to one of its aspects, an electrical assembly, comprising:

- a base part; and
- a removable part configured to be fixed in a removable manner on the base part, the base part comprising:

- a flexible membrane delimiting, at least in part, a leaktight internal volume,
- at least one movable electrically conducting element, carried by the membrane, and extending, at least in part, in the internal volume, and
- at least one internal electrical contact disposed in the internal volume under the movable conducting element, the movable conducting element contacting, during a deformation of the membrane related to the assembly of the removable part on the base part, the internal electrical contact for the establishment of an electrical connection between them, and being distant from the internal electrical contact in the absence of fixing of the removable part on the base part.

Contact between the movable conducting element and the internal electrical contact, during assembly, allows the flow of an electrical current.

Before assembly, there is no electrical connection and no external element of the base part is under voltage. After assembly, there is creation of an electrical connection which allows the flow of an electric current and which is made safe since it is protected by the assembly. At no time is the user exposed to a risk of contact with an element that may generate an electric discharge.

The expression "in a removable manner" is understood to mean that the removable part can be assembled and disassembled from the base part at will, joining being effected for example by interlocking, in particular with friction, snap-fastening, screwing, interlinking of bayonet type, intervention of at least one third party element, cooperation of shapes, magnetic assembly or yet otherwise.

The expression "leaktight internal volume" is understood to mean that the assembly comprises a cavity delimited by surfaces that do not allow the penetration of water from outside the base part.

The invention finds most particularly to apply when the internal electrical contact is linked to an electrical device such as an electrical generator, in particular low-voltage, for example less than or equal to 24V, or an electrical receiver.

Contact between the movable conducting element and the internal electrical contact is, preferably, accompanied by an elastic deformation, for example of a support carrying the internal electrical contact and/or an elastic deformation of this internal electrical contact. This makes it possible to obtain good contact pressure, even in the presence of manufacturing tolerances.

The internal electrical contact can consist of a helical or leaf spring, in particular flexible leaf folded back on itself.

Preferably, the movable conducting element and the internal electrical contact can, in the absence of deformation of the membrane, be a distance apart of at least 0.3 mm, for example between 0.5 and 2 mm, thereby reducing the risk of accidental contact and of electrostatic discharge.

The flexible membrane deforms elastically and it is preferably made of elastomer or metal, in particular polyurethane, rubber or silicone.

The movable conducting element can be made of metal, in particular bronze, aluminium or stainless steel or of conducting plastic, for example filled with carbon or with graphite.

The assembly preferably meets standard IP67 and/or ATEX directives 1999/92/CE (use in zones 0, 1, 20 and 21 in particular) and/or ATEX directives 94/9/EC (class 1 and class 2). The mode of protection of the assembly is preferably enhanced safety "e".

Preferably, the movable conducting element passes through the membrane. The movable conducting element being fixed in a leaktight manner on the membrane, it can delimit in part with the flexible membrane the leaktight internal volume.

When the movable conducting element is a through element, the removable part can comprise an external connection element designed to cooperate electrically with this movable conducting element when the removable part is fixed on the base part. This electrical contact can be effected by simple bearing, without keying. The internal electrical contact can be linked to a first electrical device, in particular to at least one of an electrical generator and of an electrical receiver, and the external connection element is linked, at least when the removable part is fixed on the base part, to a second electrical device, in particular to the other of the electrical generator and of the electrical receiver.

Preferably, the electrical contact between the external connection element and the movable conducting element is effected, during the assembly of the removable part on the base part, before the electrical contact between the movable conducting element and the internal electrical contact.

Preferably, at least one of the removable part and of the base part comprises a relief, preferably a protruding relief, which bears, in a leaktight manner, on the other of the removable part and of the base part. This relief can have the shape of a protruding annulus which can be moulded with the membrane or come to bear on top. As a variant, the removable part and the base part can each exhibit a relief, at least one of which is moulded with the membrane.

The removable part can come to bear on the membrane exclusively through the relief. The relief allows in particular, during assembly, the removable part to bear on the flexible membrane of the base part so as to deform it and allow electrical connection between the movable conducting element and the internal electrical contact.

The membrane make it possible to obtain a leaktight electrical connection at the level of the bearing between the removable part and base part without the use of add-on gasket seals.

The membrane can then play a dual function, of establishing a leaktight connection on the one hand and of support of the movable conducting element or elements on the other hand.

The membrane can, during its deformation, form, at its periphery, a bead delimiting a cup.

Preferably, the leaktightness of the contact defined by the aforementioned relief is achieved before the contact between the movable conducting element and the internal electrical contact.

The external connection element can be linked electrically in a permanent or non-permanent manner to the second electrical device.

When the connection is not permanent, the external connection element can be designed to move and to contact, when the removable part is fixed on the base part, an additional electrical contact for the establishment of an electrical connection between them, this additional contact being linked in a permanent manner to the second electrical device.

In particular, the removable part can be of similar construction to the base part, and comprise in particular:

- a flexible membrane delimiting, at least in part, a leaktight internal volume,
- at least one movable electrically conducting element, carried by the membrane, and passing through the membrane, and
- at least one internal electrical contact disposed in the internal volume under the movable conducting element.

The movable conducting element contacts, during a deformation of the membrane related to the assembly of the removable part on the base part, the internal electrical contact for the establishment of an electrical connection between them, and is distant from the internal electrical contact in the absence of fixing of the removable part on the base part.

The flexible membrane of the removable part can, by deforming, form, at its periphery, a bead delimiting a cup.

Preferably, during assembly of the removable part on the base part, the membranes of the base part and of the removable part each deform to form a bead, the beads of the base part and of the removable part coming into contact with one another so as to delimit an intermediate volume, in particular a leaktight intermediate volume, in which contact is established between the movable conducting element of the base part and the movable conducting element of the removable part.

The base part can comprise at least two distinct movable conducting elements and at least two distinct electrical contacts, each movable conducting element contacting, when the removable part and the base part are assembled, a respective internal electrical contact for the establishment of an electrical connection between them.

The internal electrical contacts are for example linked to the two terminals of an electrical generator.

The two movable conducting elements can be through elements, the removable part comprising at least two distinct external connection elements intended to each come into contact with one of the movable conducting elements when the removable part is fixed on the base part.

At least one of the removable part and of the base part can be linked to an electrical source or an electrical receiver and the other of the removable part and of the base part be linked to the other of the electrical source and of the receiver. The assembly of the removable part and the base part then makes it possible to electrically power the electrical receiver with the electrical source.

In a variant, the base part comprises at least two internal electrical contacts, the movable conducting element contacting, during the fixing of the removable part on the base part, the two internal electrical contacts so as to define between them a closed electrical circuit. The assembly then plays the role of switch.

The base part can comprise an external connector element linked electrically in series with the internal electrical contacts when the electrical circuit is closed. The electrical connection is effected during the contact of the movable conducting element with the internal electrical contacts.

The subject of the invention is further a treatment apparatus comprising a hand piece defining the base part of an assembly according to the invention and an accessory defining the removable part. The accessory is, when fixed to the hand piece, powered electrically from an electrical source internal to the hand piece, via the said assembly.

The subject of the invention is also a base part of an electrical assembly according to the invention, such as defined hereinabove, the movable conducting element being a through element.

The subject of the invention is further a base part of an electrical assembly according to the invention, such as defined hereinabove, the internal electrical contact exhibiting an inherent elasticity, consisting in particular of a leaf folded back on itself.

Figure 2:
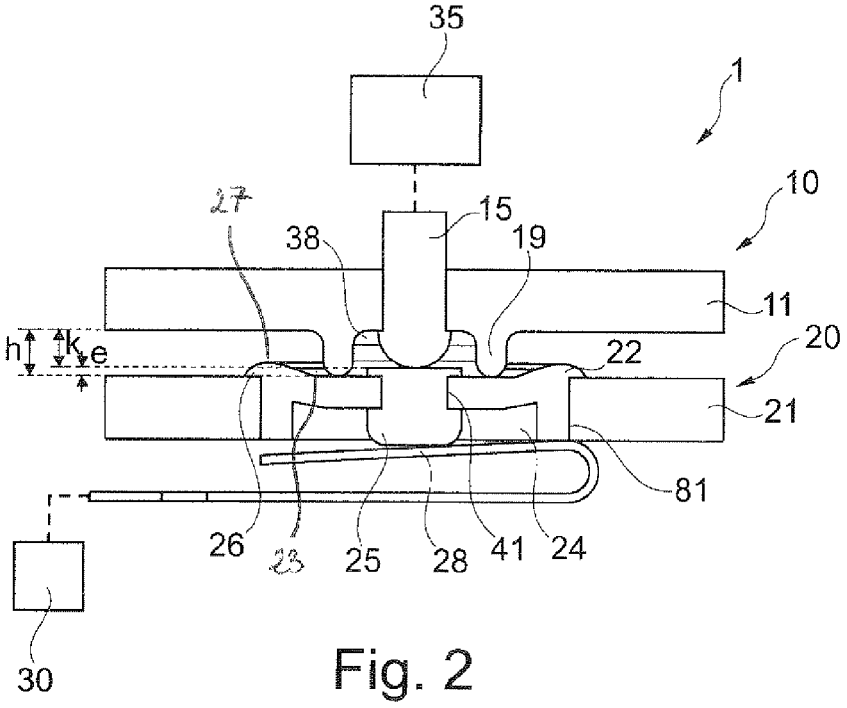
Figure 3:
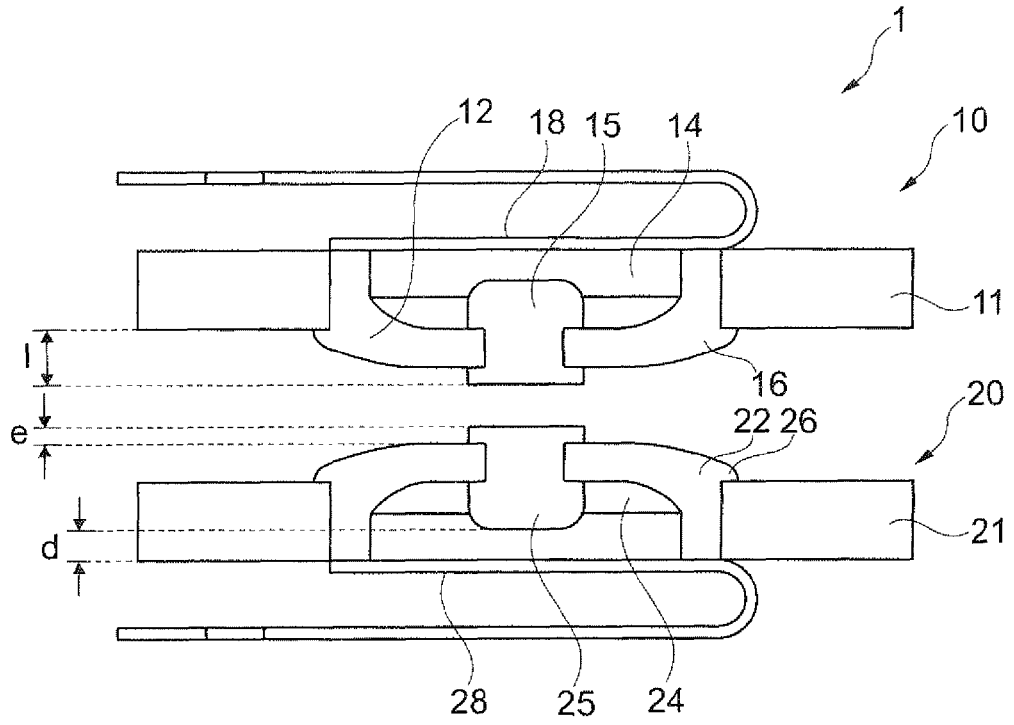
Figure 4:
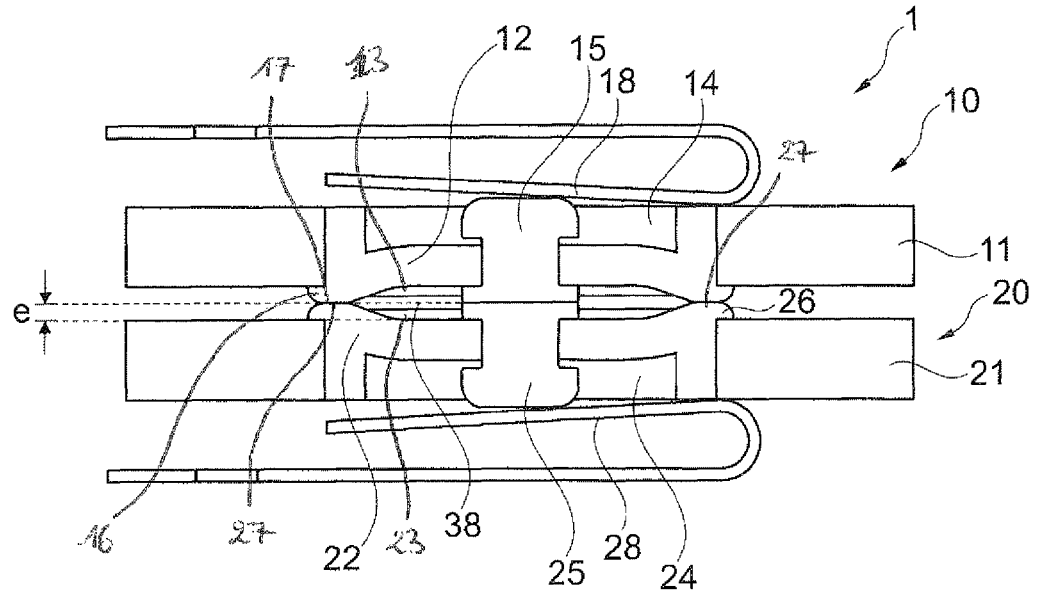
Figure 5:
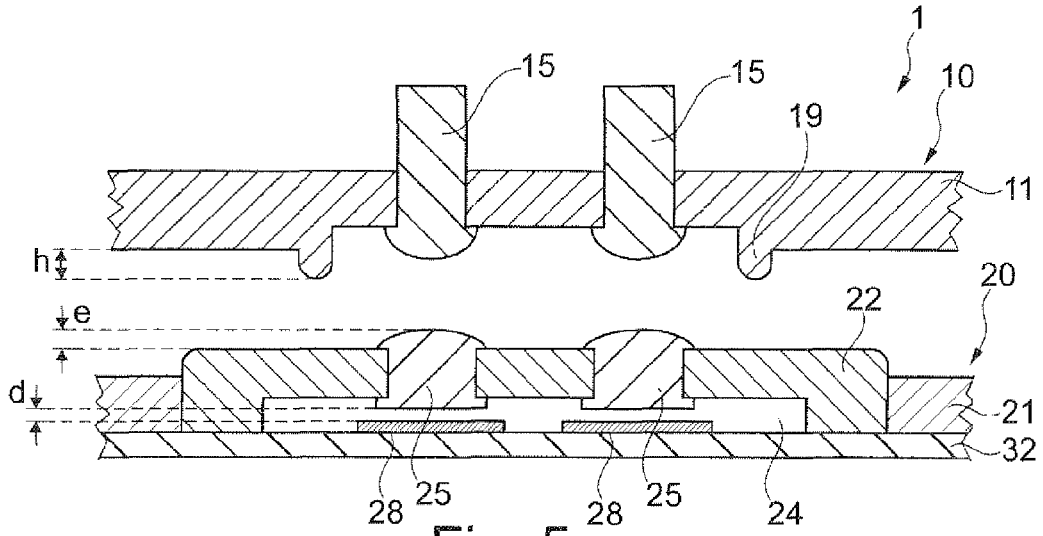
Figure 6:
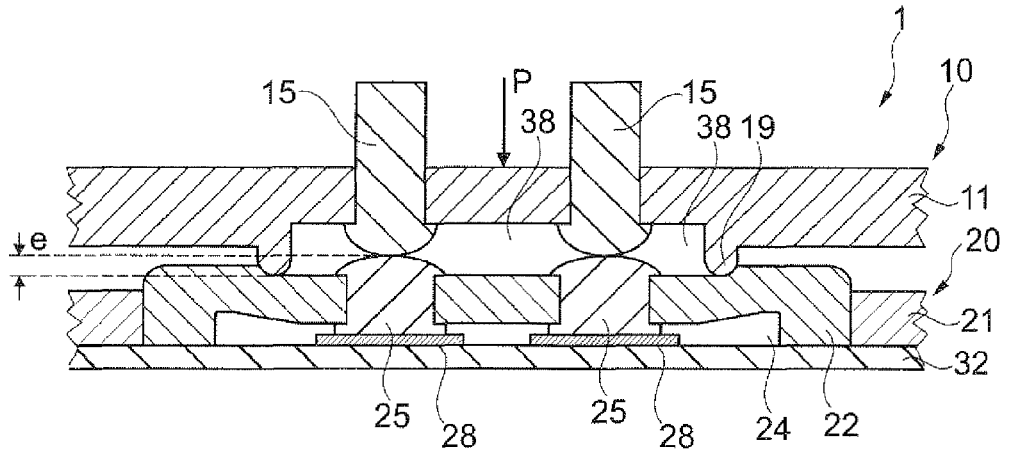
Figure 7:
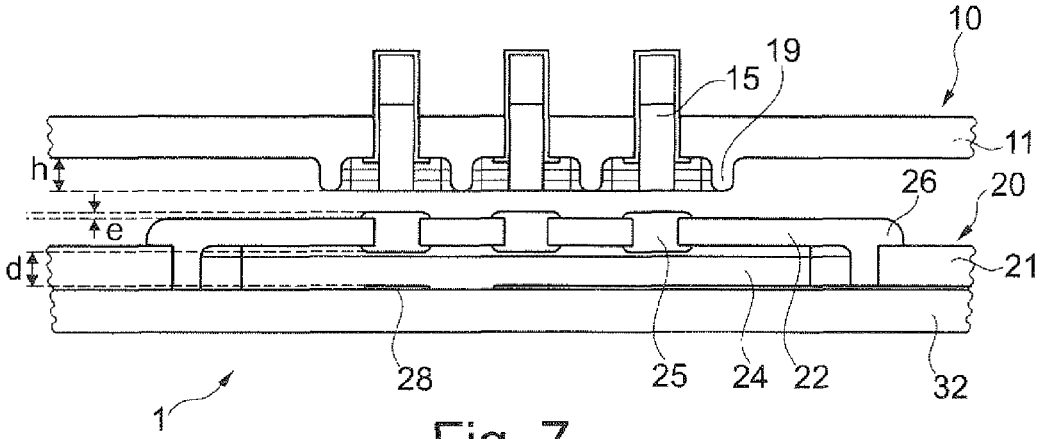
Figure 8:
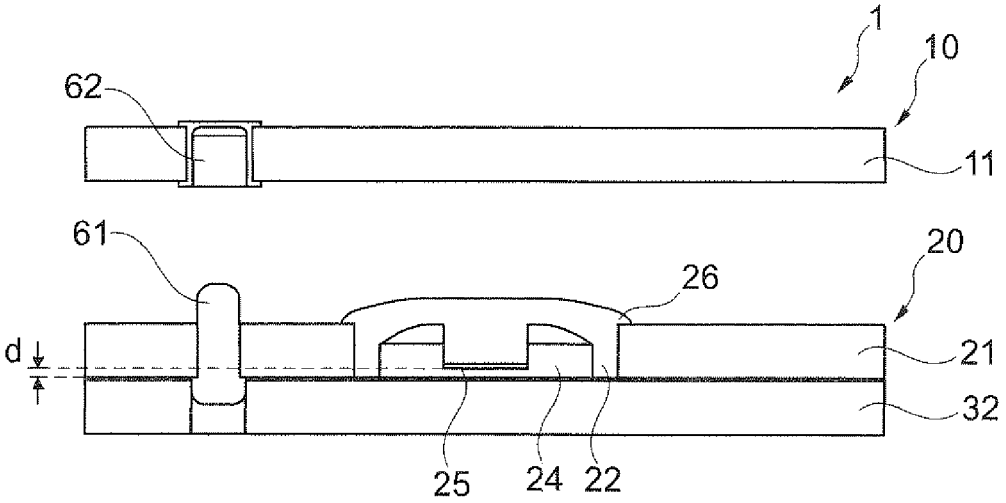
Figure 9:
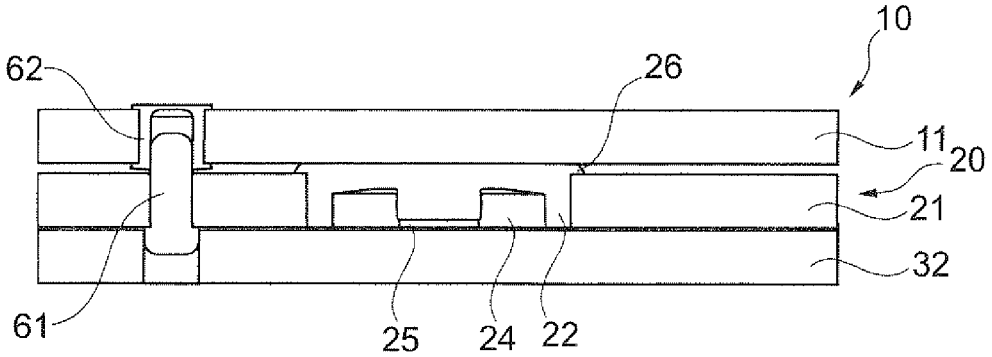
Figure 10:
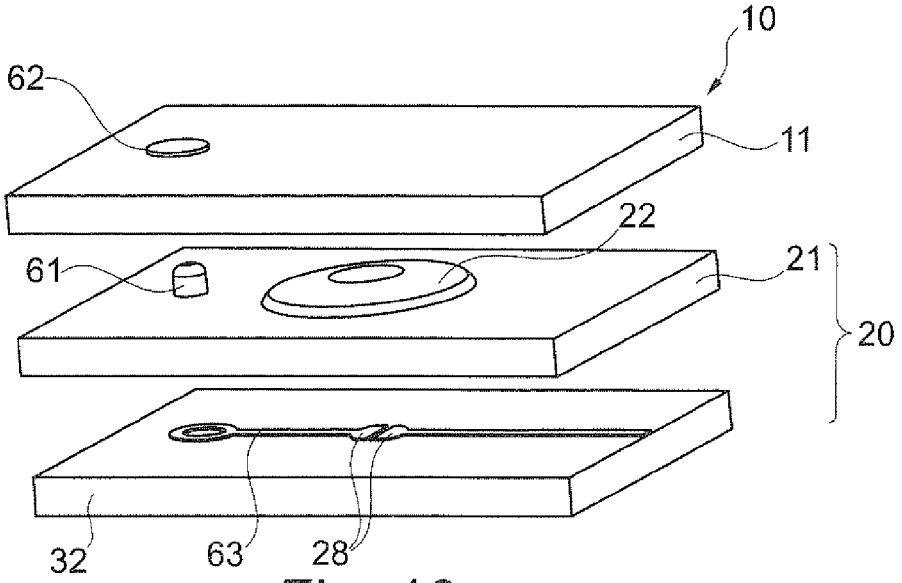
Figure 12:
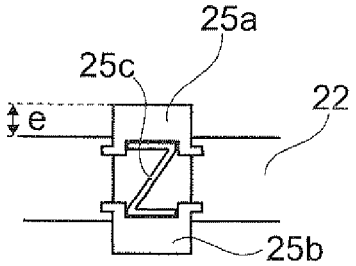
Figure 13:
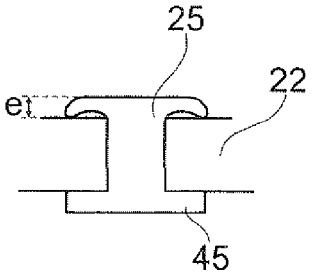
Figure 14:
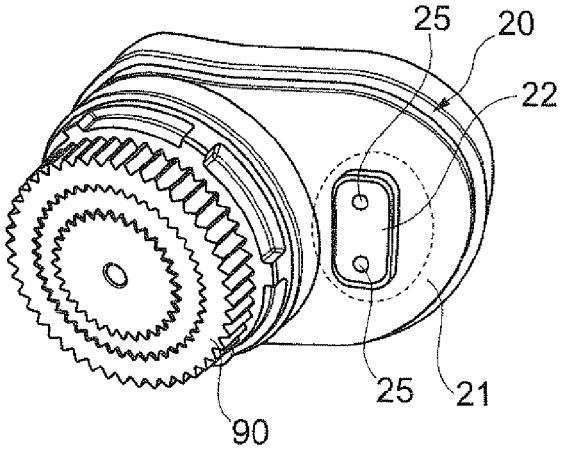
Figure 15:
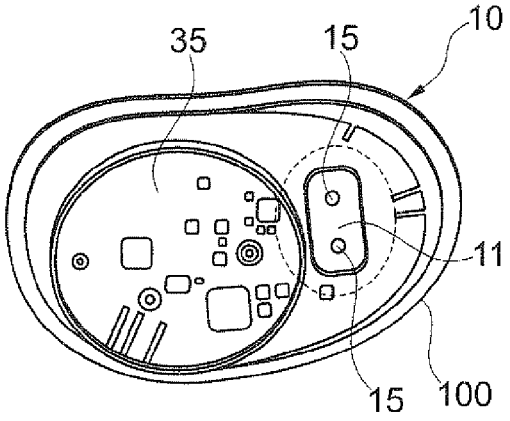

The invention may be better understood on reading the following detailed description of non-limiting illustrative examples thereof and on examining the appended drawing, in which:

FIGS. 1 and 2 are schematic sections through an assembly according to the invention, respectively before and after assembly of the movable part on the base part, FIGS. 3 and 4 are schematic sections through a variant of assembly according to the invention, respectively before and after assembly of the movable part on the base part, FIGS. 5 and 7 are schematic sections through variants of assembly according to the invention, before assembly of the movable part on the base part, FIG. 6 corresponds to FIG. 5 after assembly of the movable part on the base part, FIGS. 8 and 9 are schematic sections through a variant of assembly according to the invention, respectively before and after assembly of the movable part on the base part, FIG. 10 is an exploded view of the variant of FIGS. 8 and 9, FIGS. 11 to 13 are schematic sections through different variants of the movable conducting element according to the invention, and FIGS. 14 and 15 represent parts of an exemplary assembly according to the invention, relating to a skin treatment apparatus.

Represented in FIG. 1 is an electrical assembly 1 comprising a base part 20 and a removable part 10 configured to be fixed in a removable manner on the base part 20.

The base part 20 comprises a support 21 exhibiting an opening 81, closed by a flexible membrane 22 defining at least in part, with the remainder of the base part 20, a leaktight internal volume 24. An internal electrical contact 28 is present under the membrane 22. The latter carries a movable conducting element 25, which emerges at least in part into the leaktight internal volume 24.

As illustrated in FIG. 1, when the removable part 10 and the base part 20 are not assembled, the movable conducting element 25 and the internal electrical contact 28 are a distance d apart.

As illustrated in FIG. 2, when the removable part 10 comes into contact, in particular through a relief 19, with the base part, it exerts a pressure on the membrane 22 which deforms. This deformation causes the movable conducting element 25 to touch the internal electrical contact 28.

An intermediate volume 38, being delimited by the relief 19, is defined between the membrane 22 and the removable part 10.

The intermediate volume 38 is, preferably, leaktight, the bearing of the relief 19 on the membrane 22 being of closed contour.

The membrane 22 can be made of elastomer or of metal, in particular of polyurethane, rubber or silicone.

The membrane 22 can be overmoulded in a leaktight manner on the support 21. As illustrated in FIG. 1, the flexible membrane 22 can exhibit at its periphery a rim 26 bearing on the edge of the opening 81 of the support 21, which aids in particular the membrane 22 to remain in the opening of the support 21 when the removable part 10 exerts a pressure on the membrane 22.

The hardness of the membrane 22 is preferably between 5 Shore A and 75 Shore A.

The membrane 22 can comprise one or more reliefs, not represented, facilitating its deformation and/or allowing better contact with the removable part 10.

The movable conducting element 25 can consist of any suitable material, in particular metallic or a conducting plastic, for example filled with carbon, preferably with bronze, aluminium, or stainless steel.

In the example illustrated, the movable conducting element 25 passes through the membrane 22 in a leaktight manner and delimits in cooperation with the flexible membrane 22 the internal volume 24.

The movable conducting element 25 can project or, preferably, be set back from the flexible membrane 22 by a non-zero distance e. The element 25 can be solid, as illustrated, and its external contact surface plane, concave or convex outwardly.

The movable conducting element 25 can, as illustrated in FIG. 1, exhibit an annular throat 41 in which the membrane 22 is engaged. The fixing of the membrane 22 in the throat 41 can be effected by overmoulding of the membrane 22 on the movable conducting element 25 or by force-fitting and snap-fastening of the movable conducting element 25 in a hole of the membrane 22, provided for this effect.

Figure 11:
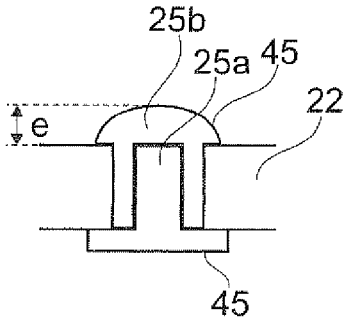

The movable conducting element 25 can be produced in diverse forms, and for example, as illustrated in FIG. 11, the movable conducting element 25 can be in two parts 25*a* and 25*b* assembled together on either side of the membrane 22, in particular by screwing, snap-fastening, or riveting.

In the variant illustrated in FIG. 12, the movable conducting element 25 is in three parts 25*a*, 25*b* and 25*c*, two of which 25*a* and 25*b* define the external contact surfaces and the third of which 25*c* ensures electrical connection between the other two parts 25*a* and 25*b*.

As a variant, as illustrated in FIG. 13, the movable conducting element 25 exhibits a widened end 45 bearing on one side of the membrane 22 and an opposite end pushed back on the other side of the membrane 22.

As illustrated in FIG. 1, the internal electrical contact 28 can undergo, during the fixing of the removable part 10 on the base part 20, an elastic deformation, by being pushed back by the movable conducting element 25.

The internal electrical contact 28 can be a flexible leaf spring folded back on itself. This elasticity allows, during the fixing of the removable part 10 on the base part 20, compensation of the play, in particular related to the manufacturing tolerances, and contact pressure guaranteeing electrical continuity.

In the variant illustrated in FIGS. 5 and 6, the internal electrical contact 28 is carried by a support 32.

The internal electrical contact 28 is for example in the form of a printed circuit. The support 32 can flex during the contact of the internal connection element 28 and of the movable conducting element 25.

The internal electrical contact 28 is, preferably, linked in a permanent manner to an electrical device 30, in particular an electrical generator or an electrical receiver.

The removable part 10 can comprise an external connection element 15 fixed to a base 11 and intended to cooperate with the movable conducting element 25 during the fixing of the removable part 10 to the base part 20.

The external connection element 15 can be protruding on the removable part 10, while being for example situated set back with respect to the relief 19.

The external connection element 15 is preferably made of metal or of a conducting plastic, for example filled with carbon, in particular of bronze, aluminium or stainless steel. It can be solid, and its external connection surface plane or outwardly convex, as illustrated.

The external connection element 15 is, preferably, linked to an electrical device 35, in particular an electrical generator if the internal electrical contact 28 is linked to an electrical receiver, or to an electrical receiver if the internal electrical contact 28 is linked to an electrical generator.

The external connection element 15 can be linked in a permanent or non-permanent manner to the electrical device 35.

Preferably, during the fixing of the removable part 10 on the base part 20, the external connection element 15 comes into contact with the movable conducting element 25 and then the relief or reliefs 19 of the base 11 of the removable part 10 come into leaktight contact with the flexible membrane 22 and then deform it in such a way that the movable conducting element 25 comes into contact with the internal electrical contact 28. The leaktightness of the intermediate volume 38 is ensured through the contact between the relief or reliefs of the base 11 of the removable part 10 and the flexible membrane 22 before contact between the movable conducting element 25 and the internal electrical contact 28 so as to effectively make the assembly safe in relation to the exterior environment. There is therefore an electrical connection between the external connection element 15 and the internal electrical contact 28, which allows the current to be made to pass from the electrical generator to the electrical receiver in a watertight environment.

Conversely, during the separation of the removable part 10 and of the base part 20, the physical separation of the internal electrical contact 28 and of the movable conducting element 25 is achieved before the separation of the relief or reliefs with the flexible membrane and the separation of the external connection element 15 with the movable conducting element 25.

Thus the electric current flowing from the electrical generator to the electrical receiver can flow only when the assembly is totally leaktight and is therefore never in contact with the exterior environment. Electrostatic discharges can only appear in the internal volume which is leaktight with respect to the exterior medium and cannot generate any risk for the user, in particular of explosion relating to the possible explosive nature of the exterior environment.

Preferably, the flexible membrane 22, under the action of the removable part 10, deforms to form a cup 23 delimited laterally by a bead 27 formed in particular by the rim 26 bearing on the edge of the opening 81 of the support 21.

Preferably, the dimensions and spaces of the elements of the assembly 1, in particular the height h of the reliefs 19, the distance d between the movable conducting element 25 and the internal electrical contact 28, the distance e by which the movable conducting element 25 projects from or is set back with respect to the flexible membrane 22 and the height k of the internal connection element 15 projecting from the base 11 of the removable part 10, are such that the contacts between the elements, during assembly of the removable part 10 and the base part 20, occur in the order stated above.

In the variant illustrated in FIGS. 3 and 4, the external connection element 15 contacts, during the fixing of the removable part 10 on the base part 20, an additional electrical contact 18 for the establishment of an electrical connection between them, the additional contact 18 being linked to the electrical device 35.

The removable part 10 can in particular be similar to the base part 20, the additional electrical contact 18 being an internal electrical contact, the external connection element 15 being a movable conducting element carried by a flexible membrane 12.

The removable part 10 can have the same characteristics as the base part 20 detailed hereinabove.

Preferably, the membrane 12 of the removable part 10 has the same characteristics as the flexible membrane 22 of the base part 20. As a variant, the membrane 12 of the removable part 10 can be different from the flexible membrane 22 of the base part 20.

During the fixing of the removable part 10 on the base part 20, the movable conducting element 15 of the removable part 10 contacts the movable conducting element 25 of the base part 20.

Bringing the parts 10 and 20 together gives rise to a simultaneous deformation of the two flexible membranes 12 and 22, which allows contact of the movable conducting elements 15 and 25 with the respective internal electrical contacts 18 and 28. Preferably, the distance l between the external surface of the movable conducting element 15 (or 25) and the external part of the support 11 (or 21) is greater than the distance d between the movable conducting elements 15 (or 25) and the respective internal electrical contacts 18 (or 28).

During the deformation of the flexible membranes 12 and 22, the latter each form a cup 13 and 23 delimited laterally by a bead 17 and 27 formed by the rim 16 and 26. The beads 17 and 27 come into contact with one another to define between them the intermediate volume 38. The beads 17 and 27 make it possible, by coming into contact, to ensure the leaktightness of the intermediate volume 38 so that, at the time of electrical contact, the intermediate volume 38 is totally leaktight.

As a variant, at least one of the two membranes 12 and 22 comprises a relief, preferably protruding, bearing, during the fixing of the removable part 10 on the base part 20, on the other of the membranes 12 and 22 to cause the two membranes 12 and 22 to deform simultaneously.

In the variant illustrated in FIGS. 5 and 6, the base part 20 comprises at least two distinct movable conducting elements 25, and at least two distinct internal electrical contacts 28, each movable conducting element 25 contacting one of the internal electrical contacts 28 for the establishment of electrical contact between them.

Preferably, the movable conducting elements 25 are through elements and they each contact an external connection element 15.

The invention is not limited to a particular number of electrical connections.

In the variant illustrated in FIG. 7, the assembly comprises three movable conducting elements 25, three internal electrical contacts 28 and three external connection elements 15.

In the variant illustrated in FIGS. 8 to 10, the base part 20 comprises two distinct internal electrical contacts 28, and a movable conducting element 25, the movable conducting element 25 contacting, when the removable part 10 and the base part 20 are assembled, the two internal electrical contacts 28 so as to define a closed circuit. The movable conducting element 25 makes it possible, after assembly, to cause the current to pass from the first to the second internal electrical contact 28. The base part 20 plays the role of a switch actuated when the removable part 10 is fixed on the base part 20, the removable part 10 deforming the flexible membrane 22.

The movable conducting element 25 is, preferably, totally included in the leaktight internal volume 24.

It is seen in FIGS. 8 and 9 that the parts 10 and 20 can carry male and female connector elements 61, 62 which cooperate when the parts 10 and 20 are brought together.

The closing or otherwise of the circuit by virtue of the movable conducting element 25 can be used to turn on or otherwise the connector element 61, the latter being linked, as illustrated, by a track 63 to one of the contacts 28.

Thus, when the circuit is open in the absence of the movable conducting element 25, the connector element 61 is not linked electrically to the remainder of the circuit, and when the circuit is closed, it becomes so.

The assembly according to the invention finds to apply to numerous sectors.

By way of example, FIGS. 14 and 15 illustrate an exemplary application to an apparatus for treating the body or the face, including the hair, comprising a hand piece housing an electrical source, and exhibiting a treatment member such as a brush 90.

An accessory 100 can be fitted onto the hand piece, comprising for example a member making it possible to carry out a different treatment from that of the hand piece. This accessory requires an electrical power supply.

The hand piece defines the base part 20 of the electrical assembly according to the invention and exhibits a membrane 22 carrying two movable conducting elements 25.

Two unseen internal electrical contacts are respectively linked to the terminals of an electrical source housed in the hand piece.

The accessory defines the removable part 10 and carries two electrical contacts 15 intended to contact respectively the movable conducting elements 25 when the accessory 100 is fixed on the hand piece 90, for example by snap-fastening or interlocking with friction.

Fitting the accessory 100 gives rise to the deformation of the membrane 22 and the establishment of an electrical connection between the elements 25 and the contacts 18. Thus, the external contacts 15 carried by the accessory 100 can be powered by the electrical source of the hand piece. The membrane 22 ensures the leaktightness of the electrical connection.

In the absence of accessory 100, the movable conducting elements 25 are not powered and the user does not risk being exposed to the voltage of the electrical source even if he accidentally touches the elements 25. Moreover, should the hand piece be used in water, electrolysis is prevented from taking place between the elements 25, which could sap the electrical source and oxidize the contacts.

The assembly 1 such as described hereinabove can also be used in a medium exhibiting risks of explosions, in particular an ATEX environment. The removable part 10 can then be changed without any particular precaution, since the risk of sparks is confined to the internal space 24.

The invention is not limited to the exemplary embodiments which have just been described, whose characteristics can be combined within variants that are not illustrated.

One and the same apparatus can carry a plurality of membranes and of movable conducting elements such as described hereinabove, optionally being able to be linked to the same electrical devices.

The expression "comprising a" should be understood as being synonymous with "comprising at least one", and "is between" is understood as including the limits, unless specified to the contrary.

The invention claimed is:

1. Electrical assembly, comprising:

a base part, and a removable part configured to be fixed in a removable manner on the base part, the base part comprising:

a flexible membrane delimiting, at east in part, a leaktight internal volume, at east one movable electrically conducting element, carried by the membrane, and extending, at east in part, in the internal volume, and at least one internal electrical contact disposed n the internal volume under the movable conducting element, the movable conducting element contacting, during a deformation of the membrane related to the assembly of the removable part on the base part, the internal electrical contact for the establishment of an electrical connection between them, and being spaced from the internal electrical contact in the absence of fixing of the removable part on the base part, at least one of the removable part and of the base part comprising a relief, which bears, in a leaktight manner, on the other of the removable part and of the base part, the leaktight condition defined by the relief being achieved before subsequent contact between the movable conducting element and the internal electrical contact, and the removable part bearing on the membrane exclusively through the relief.

2. Assembly according to claim 1, the internal electrical contact being linked to an electrical device comprising one of an electrical generator and an electrical receiver.

3. Assembly according to claim 1, the flexible membrane forming, during its deformation, at its periphery, a bead delimiting a cup.

4. Assembly according to claim 1, the movable conducting element and the internal electrical contact being, in the absence of deformation of the membrane, a distance d apart of greater than or equal to 0.3 mm.

5. Treatment apparatus comprising:

a hand piece defining the base part of the assembly according to claim 1;

an electrical source internal to the hand piece; and an accessory defining the removable part of the assembly according to claim 1, the accessory being, when fixed on the hand piece, powered electrically from the electrical source via the said assembly.

6. Assembly according to claim 1, the relief comprising a protruding relief.

7. Assembly according to claim 1, the contact between the movable conducting element and the internal electrical contact being accompanied by an elastic deformation.

8. Assembly according to claim 7, the internal electrical contact consisting of a flexible leaf folded back on itself.

9. Assembly according claim 1, the base part comprising at least two distinct movable conducting elements and at least two distinct internal electrical contacts, each movable conducting element contacting, when the removable part and the base part are assembled, a respective internal electrical contact for the establishment of an electrical connection between them.

10. Assembly according to claim 9, the movable conducting elements being through elements, the removable part comprising at least two external connection elements configured to each come into contact with one of the movable conducting elements when the removable part is fixed on the base part.

11. Assembly according to claim 1, the base part comprising at least two internal electrical contacts, the movable conducting element contacting, during the fixing of the removable part on the base part, the two internal electrical contacts so as to define between them a closed electrical circuit.

12. Assembly according to claim 11, the base part comprising an external connector element linked electrically in series with the two internal electrical contacts when the electrical circuit is closed.

13. Assembly according to claim 1, the movable conducting element passing through the membrane.

14. Assembly according to claim 13, the removable part comprising an external connection element configured to cooperate electrically with the movable conducting element when the removable part is fixed on the base part.

15. Assembly according to claim 14, the electrical cooperation between the external connection element and the movable conducting element being effected by contact therebetween.

16. Assembly according to claim 14, the internal electrical contact being linked to a first electrical device comprising at least one of an electrical generator and of an electrical receiver, the external connection element being linked, at least when the removable part is fixed on the base part, to a second electrical device.

17. Assembly according to claim 16, the external connection element being electrically linked in a permanent manner to the second electrical device.

18. Assembly according to claim 16, the removable part comprising:

a flexible membrane delimiting, at least in part, a leaktight internal volume, at least one movable electrically conducting element, carried by the membrane, and passing through the membrane, and at least one internal electrical contact disposed in the internal volume under the movable conducting element, the movable conducting element of the removable part contacting, during a deformation of the membrane of the removable part related to the assembly of the removable part on the base part, the internal electrical contact of the removable part for the establishment of an electrical connection between them, and being spaced from the internal electrical contact of the removable part in the absence of fixing of the removable part on the base part.

19. Assembly according to claim 18, the flexible membrane of the removable part forming, by deforming, at its periphery a bead delimiting a cup.

20. Assembly according to claim 19, the flexible membrane of the base part forming, during its deformation, at its periphery, a bead delimiting a cup, during assembly of the removable part on the base part, the bead of the base part and the bead of the removable part coming into contact with one another so as to delimit an intermediate volume in which contact is established between the movable conducting element of the base part and of the movable conducting element of the removable part.

* * * * *